US009568262B2

(12) United States Patent
Bantle et al.

(10) Patent No.: US 9,568,262 B2
(45) Date of Patent: Feb. 14, 2017

(54) DISASSEMBLY DEVICES FOR USE WITH FIREARMS AND FIREARMS INCLUDING SUCH DISASSEMBLY DEVICES

(71) Applicant: HECKLER & KOCH GMBH, Oberndorf (DE)

(72) Inventors: Hans-Peter Bantle, Dunningen-Seedorf (DE); Daniel Braun, Sindelfingen (DE); Stefan Doll, Oberndorf-Beffendorf (DE); Frank Henninger, Oberndorf-Beffendorf (DE); Rolf Knöpfle, Alpirsbach (DE); Gerd Spinner, Oberndorf-Bochingen (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 14/980,328

(22) Filed: Dec. 28, 2015

(65) Prior Publication Data

US 2016/0146559 A1 May 26, 2016

Related U.S. Application Data

(63) Continuation-in-part of application No. PCT/EP2014/001774, filed on Jun. 27, 2014.

(30) Foreign Application Priority Data

Jul. 1, 2013 (DE) ..... 10 2013 010 969

(51) Int. Cl.
*F41A 21/00* (2006.01)
*F41A 11/00* (2006.01)
*F41A 17/34* (2006.01)

(52) U.S. Cl.
CPC ..... *F41A 11/00* (2013.01); *F41A 17/34* (2013.01)

(58) Field of Classification Search
USPC ..... 42/75.02, 75.01, 75.04, 75.1, 17
See application file for complete search history.

(56) References Cited

U.S. PATENT DOCUMENTS 7,823,314 B1 * 11/2010 Wheatley ..... F41A 3/66 42/75.02
2004/0035286 A1 2/2004 Spinner et al.
(Continued)

FOREIGN PATENT DOCUMENTS

DE 130377 5/1900
DE 3536125 11/1997
(Continued)

OTHER PUBLICATIONS

International Searching Authority, "International Preliminary Report on Patentability", issued in connection with PCT Patent Application No. PCT/EP2014/001774, issued on Jan. 5, 2016, 7 pages.
(Continued)

*Primary Examiner* — J. Woodrow Eldred
(74) *Attorney, Agent, or Firm* — Hanley, Flight & Zimmerman, LLC

(57) ABSTRACT

Disassembly devices for use with firearms and firearms including such disassembly devices are disclosed. An example firearm includes a frame; a breech slide to be coupled to the frame; a barrel; a trigger bar disposed within the frame; and an arm to be pivotable about an axis between a locked position and a unlocked position, the arm being movable to the unlocked position from the locked position based on a magazine engaging an end of the arm, the arm being movable to the locked position from the unlocked position based on the magazine being spaced from the end of the arm or the magazine not being fully received within the firearm, in the locked position, the arm to interact with
(Continued)

the trigger bar to secure the trigger bar, in the unlocked position, the lug to be spaced from the trigger bar to enable the trigger bar to move.

16 Claims, 10 Drawing Sheets

(56) References Cited

U.S. PATENT DOCUMENTS

| | | | | |
|---|---|---|---|---|
| 2009/0071053 | A1 | 3/2009 | Thomele et al. | |
| 2010/0281742 | A1* | 11/2010 | Barrett | F41A 11/04 42/75.02 |
| 2010/0319233 | A1 | 12/2010 | Wray | |
| 2012/0085010 | A1* | 4/2012 | Cook | F41A 19/11 42/7 |
| 2012/0180354 | A1* | 7/2012 | Sullivan | F41A 3/26 42/16 |

FOREIGN PATENT DOCUMENTS

| | | |
|---|---|---|
| DE | 102004050452 | 6/2006 |
| DE | 10008979 | 1/2007 |
| EP | 2116804 | 11/2009 |
| GB | 151196 | 9/1920 |
| WO | 2010010410 | 1/2010 |

OTHER PUBLICATIONS

International Searching Authority, "Written Opinion", issued in connection with PCT Patent Application No. PCT/EP2014/001774, mailed on Sep. 16, 2014, 11 pages.

International Searching Authority, "International Search Report", issued in connection with PCT Patent Application No. PCT/EP2014/001774, mailed on Sep. 16, 2014, 8 pages.

German Patent Office, "Office Action", issued in connection with German Patent Application No. 10 2013 010 969.8, issued on Nov. 22, 2013, 8 pages.

* cited by examiner

DISASSEMBLY DEVICES FOR USE WITH FIREARMS AND FIREARMS INCLUDING SUCH DISASSEMBLY DEVICES

RELATED APPLICATION

This patent is a continuation-in-part of International Patent Application Serial No. PCT/EP2014/001774, filed Jun. 27, 2014, which claims priority to German Patent Application 10 2013 010 969.8, filed on Jul. 1, 2013, both of which are hereby incorporated herein by reference in their entireties.

FIELD OF THE DISCLOSURE

This patent relates generally to disassembly devices for use with firearms and, more specifically, to disassembly devices for use with firearms and firearms including such disassembly devices.

BACKGROUND

Some semi-automatic pistols include a slide release lever that deters against unintentional disassembly of the pistol. To disassemble and/or dismantle such semi-automatic pistols, the slide release lever may be actuated to enable the pistol to be cleaned and/or maintenanced.

DETAILED DESCRIPTION

Figure 1:
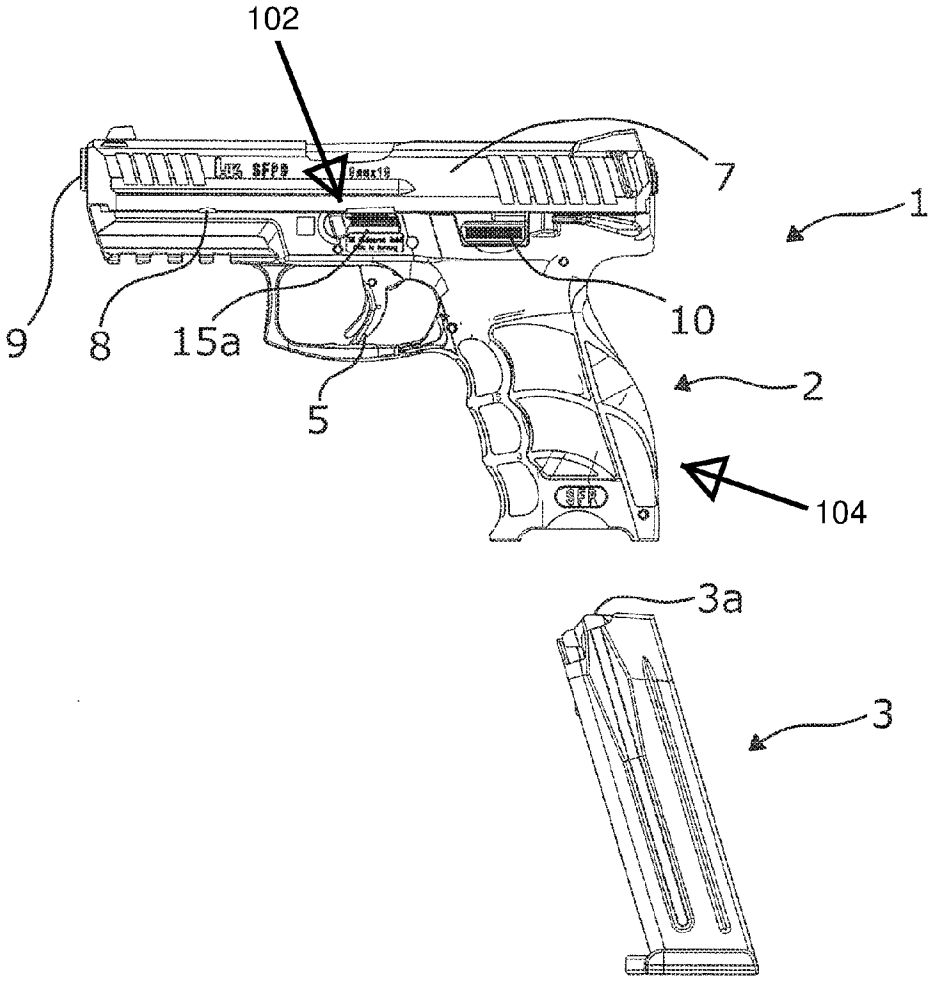
FIG. 1 illustrates side view of an example pistol and an example magazine removed from the pistol.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples disclosed herein relate to disassembly devices for use with pistols such as, for example, self-loading pistols, semi-automatic pistols, automatic pistols, etc. In some examples, the example disassembly devices include an example shaft disposed within a frame and/or a grip of the pistol. In some examples, the example shaft is coupled to an example handle that is externally disposed to enable the handle and the shaft to be rotated between a locked position and an unlocked position. In some examples, the example disassembly device includes an example disassembly arm or an example disassembly protection element that is movable between a locked positioned and an unlocked position. In some examples, in the locked position of the disassembly arm, a first end of the disassembly arm engages the example shaft and/or a notch of the shaft to fix the shaft is a secured and/or locked position. In some examples, in the unlocked position of the disassembly arm, the first end of the disassembly arm is spaced from the example shaft and/or the notch of the shaft to enable the shaft to rotate to the unlocked, released and/or disassembly position. In some examples, when a magazine is disposed within a magazine well of the pistol, the magazine engages a second end of the disassembly arm of the disassembly device to position the disassembly arm in a locked position. In some examples, the disassembly device and/or the disassembly arm may be moved from the locked position to the unlocked and/or released position when a magazine is partially and/or fully removed from the magazine well.

To disassemble the example firearms, a marksman may hold the pistol with one hand on the grip and another hand on the breech slide from above. In some examples, the marksman pulls the breech slide rearward against the force of a recoil spring until a breech catch, a slide lock catch and/or a breech stop lever retains, holds and/or captures the breech slide in a retracted position and/or a breech stop position. In some examples, when and/or as the breech slide is being retracted, any cartridge present in a cartridge chamber of the pistol may be ejected. In some examples, when the breech slide is in the retracted position, an example disassembly device can be moved from the locked position to an unlocked position or a released position. In some examples, after the disassembly device is in the locked position, the breech slide, the barrel and the recoil spring may be moved forward relative to the frame of the pistol to separate the breech slide, the barrel and the recoil spring from the frame.

In some examples, the disassembly device includes an example dismantling shaft and/or a shaft and an example handle. In some examples, the handle is externally accessible to enable the disassembly device to be moved between a locked position, an assembly and/or assembled position and unlocked position and/or a disassembly position. In some examples, in the locked position, the shaft of the disassembly device interacts with and/or blocks a projection at an end of the barrel from passing the shaft to prevent the barrel from being removed and/or separated from the remainder of the pistol. In some examples, in the unlocked position and/or the released position, the projection at the end of the barrel is not blocked by the shaft of the disassembly device. Thus, in the unlocked position, the projection of the barrel can move past the shaft of the disassembly device to enable the pistol to be disassembled and/or for the barrel to be separated from the remainder of the pistol.

In some examples, if a magazine is disposed within a pistol and the breech slide is being retracted, the breech moves past the magazine to open a space above the magazine to enable a cartridge from the magazine to be moved into the open space, via a magazine spring, into a path of the breech slide. In some examples, as the breech slide moves forward from the rearward position, via the recoil spring, the breech slide engages the base of the upper most cartridge of the magazine and moves the cartridge into the cartridge chamber of the pistol. Thus, in some examples, there is a possibility that a cartridge is moved into the cartridge chamber as the breech slide moves forward when the pistol is being disassembled.

Some pistols, automatic pistols and/or semiautomatic pistols include a trigger, a hammer and/or are hammerless.

If the pistol includes a hammer, to fire the pistol, in some examples, the marksman may cock the hammer to ready the pistol for firing. To fire the pistol, the marksman may actuate the trigger causing the trigger mechanism to release the hammer and enable the hammer to strike the firing pin. In some examples, forward movement of the firing pin causes the firing pin to engage a percussion cap of the cartridge to ignite the cartridge and fire a round through the barrel.

If the pistol is a hammerless pistol, in some examples, the firing pin spring drives the firing pin forward when a cartridge is ignited. In some such examples, when the breech slide is released from the rearward position and as the recoil spring urges the breech slide forward, the firing pin is caught and/or retained in a rearward position and the forward moving breech slide compresses the firing pin spring. In some examples, when the marksman actuates the trigger, the firing pin is released to engage a base of the cartridge to fire a round through the barrel. In examples in which the pistol is a double-action pistol, in some examples, actuating the trigger cocks (e.g., partially or entirely) the firing pin.

In some examples of hammerless pistols and pistols having a trigger and/or a firing pin, if the pistol is disassembled when a loaded magazine is disposed within the magazine well, there is a possibility that a cartridge is loaded into the cartridge chamber when the breech slide moves from the retracted position to the forward position.

An example self-loading pistol including a device that deters disassembly of the pistol is mentioned in EP 2 116 804 A1. EP 2 116 804 A1 mentions that a magazine disposed within a magazine well urges a safety slide forward to engage a surface of a dismantling shaft to secure the dismantling shaft in a locked position. In the locked position, a lug of the barrel engages a contact surface of the dismantling shaft to substantially prevent the barrel and the breech slide from being separated from the frame of the pistol. If the magazine is removed, the safety slide is not urged forward and does not engage against the dismantling shaft. Thus, the dismantling shaft can be rotated to an unlocked and/or release position to enable the breech slide and the barrel to be separated from the frame of the pistol. To prevent the pistol from being disassembled, components of the device of EP 2 116 804 A1 are slidable relative to one another. The safety slide of EP 2 116 804 A1 is made of sheet metal and the dismantling shaft is disposed inside of the grip of the pistol.

An example self-loading pistol including a device that deters against the disassembly of the pistol is mentioned in GB 151,196. GB 151,196 mentions a control cam that is engaged by and urged upward by a magazine when the magazine is disposed within the magazine well. When the control cam is upwardly urged, the control cam is disposed within a path of the breech slide to prevent the breech slide from being separated from the frame of the pistol. When the magazine is removed from the magazine well, a spring urges the control cam downward and out of the path of the breech slide to enable the breech slide to be separated from the frame of the pistol.

FIGS. 1-4 illustrate an example pistol and/or a self-loading pistol 1 in different states and/or positions during an example process of disassembling the pistol 1. FIGS. 5-10 illustrate detailed views of an example disassembly device and/or an example disassembly prevention device 102.

In the illustrated example of FIG. 1, the example pistol 1 is illustrated in an assembled state and an example magazine 3 is shown removed from the pistol 1. In the illustrated example, the pistol includes an example grip 2 and an example breech slide and/or slide 7 that at least partially surrounds an example barrel 9. In the example of FIG. 1, the pistol 1 includes a trigger assembly and/or a trigger mechanism that is actuatable by an example trigger 5.

As illustrated in the example of FIGS. 5-8, the example disassembly device 102 and/or the example pistol 1 includes an example shaft and/or a dismantling shaft 15 proximate the trigger 5 and/or the grip 2. In this example, an example handle and/or outer handle 15*a* is coupled at an end of the shaft 15. In some examples, the handle 15*a* and/or the shaft 15 are movable and/or actuatable between a locked position and an unlocked and/or a release position. In the illustrated example, in the locked position, the handle 15*a* extends substantially horizontally toward the rear of the pistol 1. As set forth herein, substantially horizontally means approximately 3% of horizontal relative to an axis of the barrel 9 and/or accounts manufacturing tolerances.

As shown in the examples of FIGS. 5-10, the example disassembly device 102 includes the shaft 15, the handle 15*a* and an example disassembly prevention arm and/or disassembly arm 17. In some examples, when the magazine 3 is disposed within a magazine well of the pistol 1, the magazine 3 engages and urges the disassembly arm 17, against a spring force of a spring 19, into engagement with the shaft 15 to prevent rotation of the shaft 15 and the disassembly of the pistol. In some examples, the pistol is disassembled by removing the breech slide 7 and the barrel 9 from an example frame 104 and/or the grip 2 of the pistol 1. In some examples, when the magazine 3 is partially and/or entirely removed from the magazine well of the pistol 1, the spring force of the spring 19 urges the disassembly arm 17 away from the shaft 15 to enable the shaft to be rotated to the unlocked position and for the pistol 1 to be disassembled.

Figure 2:
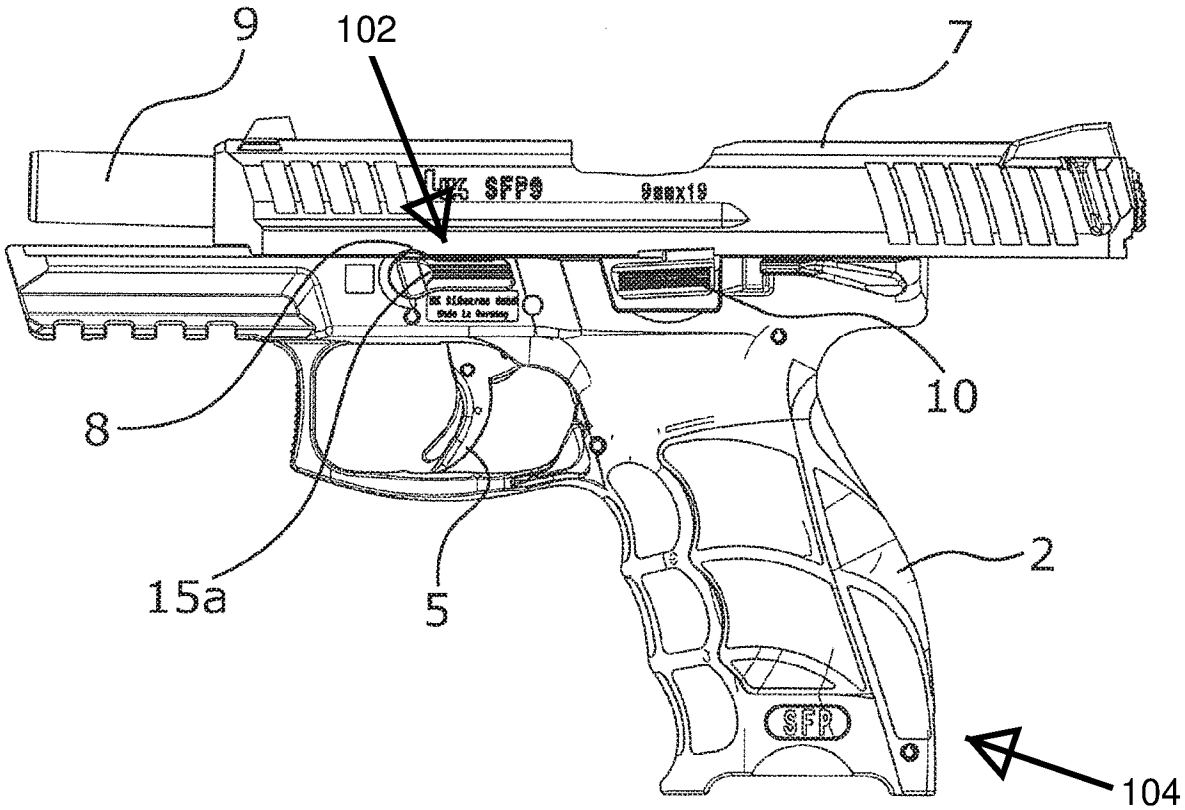
FIG. 2 illustrates a side view of the example pistol of FIG. 1 showing an example beech slide catch retaining the breech slide in a retracted position and an example disassembly device in a locked position.
Figure 3:
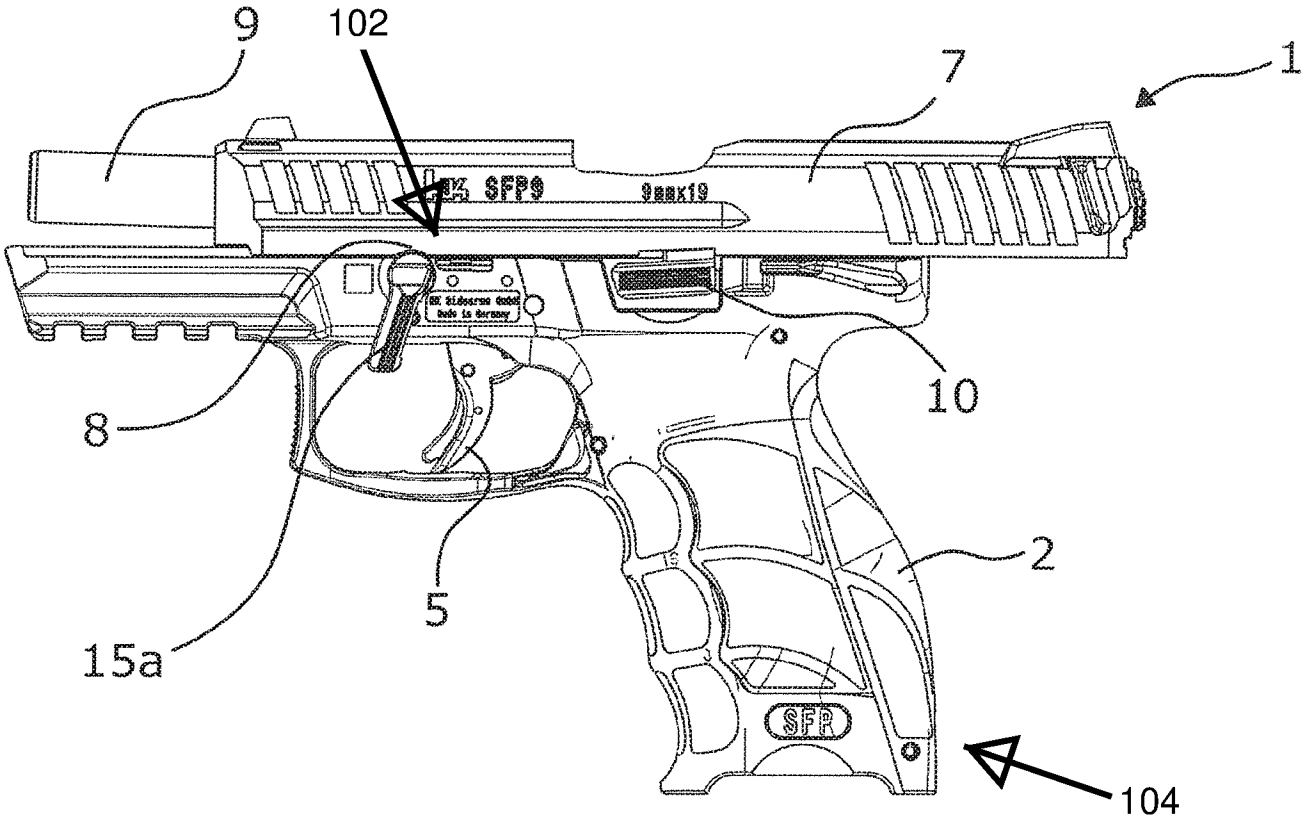
FIG. 3 illustrates a side view of the example pistol of FIG. 1 with the example breech slide in the retracted position and the example disassembly device in an unlocked position.

Referring to the example of FIG. 1, in this example, the breech slide 7 includes a recess and/or a semicircular recess 8. As shown in the examples of FIGS. 2 and 3, when the breech slide 7 is in the rearward position, the recess 8 is disposed immediately adjacent the shaft 15 to enable an arced portion of the shaft 15 and/or the handle 15*a* to be received within the recess 8 and to enable the shaft 15 to be rotated from the locked position to the unlocked and/or released position. As shown in the examples of FIGS. 5-8, the shaft 15 and/or the handle 15*a* include a surface, a flat surface, a non-projecting surface and/or a recess 29 that enables the breech slide 7 to travel rearward past the handle 15*a* when the handle 15*a* is in the locked position.

Figure 4:
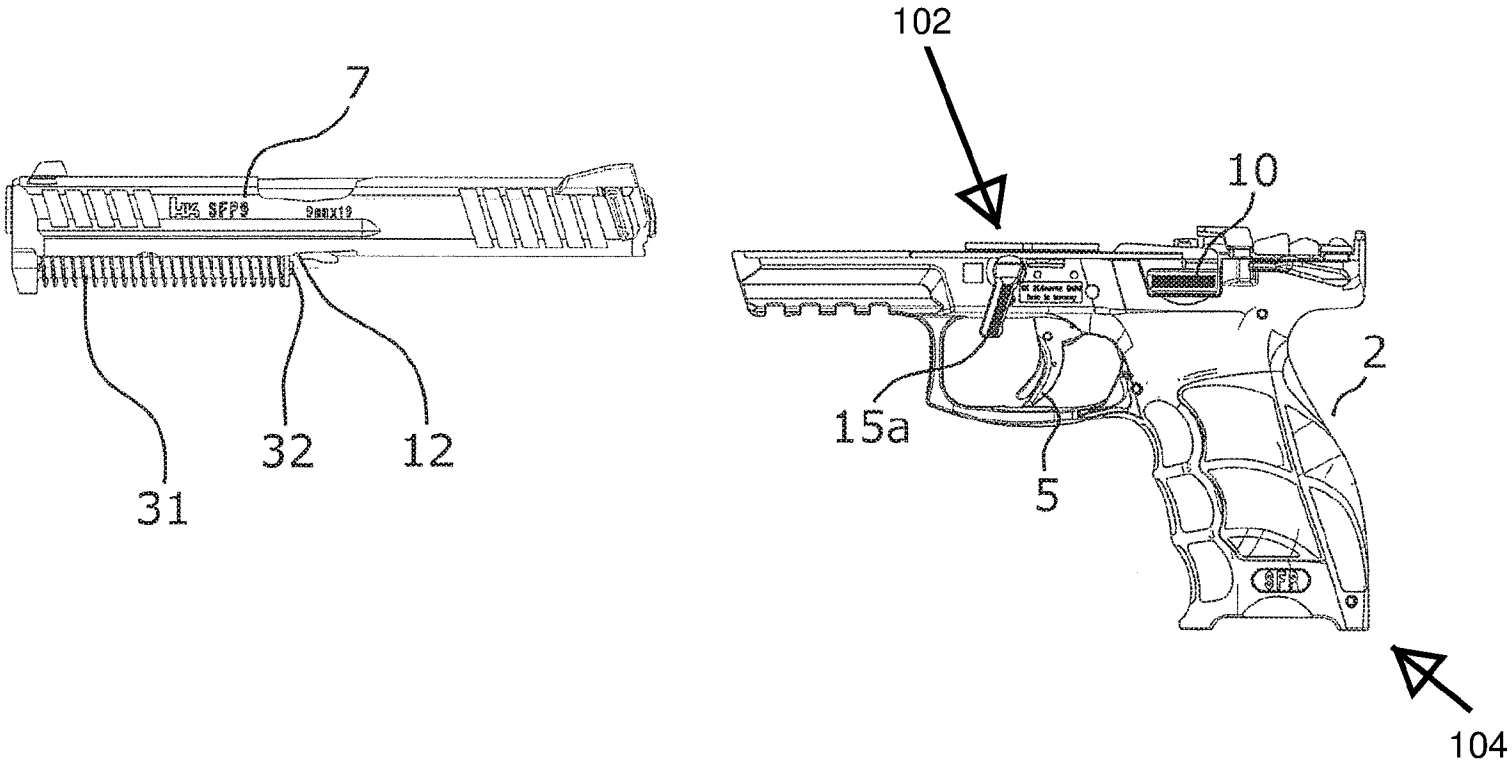
FIG. 4 illustrates a side view of the example breech slide, an example barrel and an example recoil spring separated from a frame of the pistol.
Figure 5:
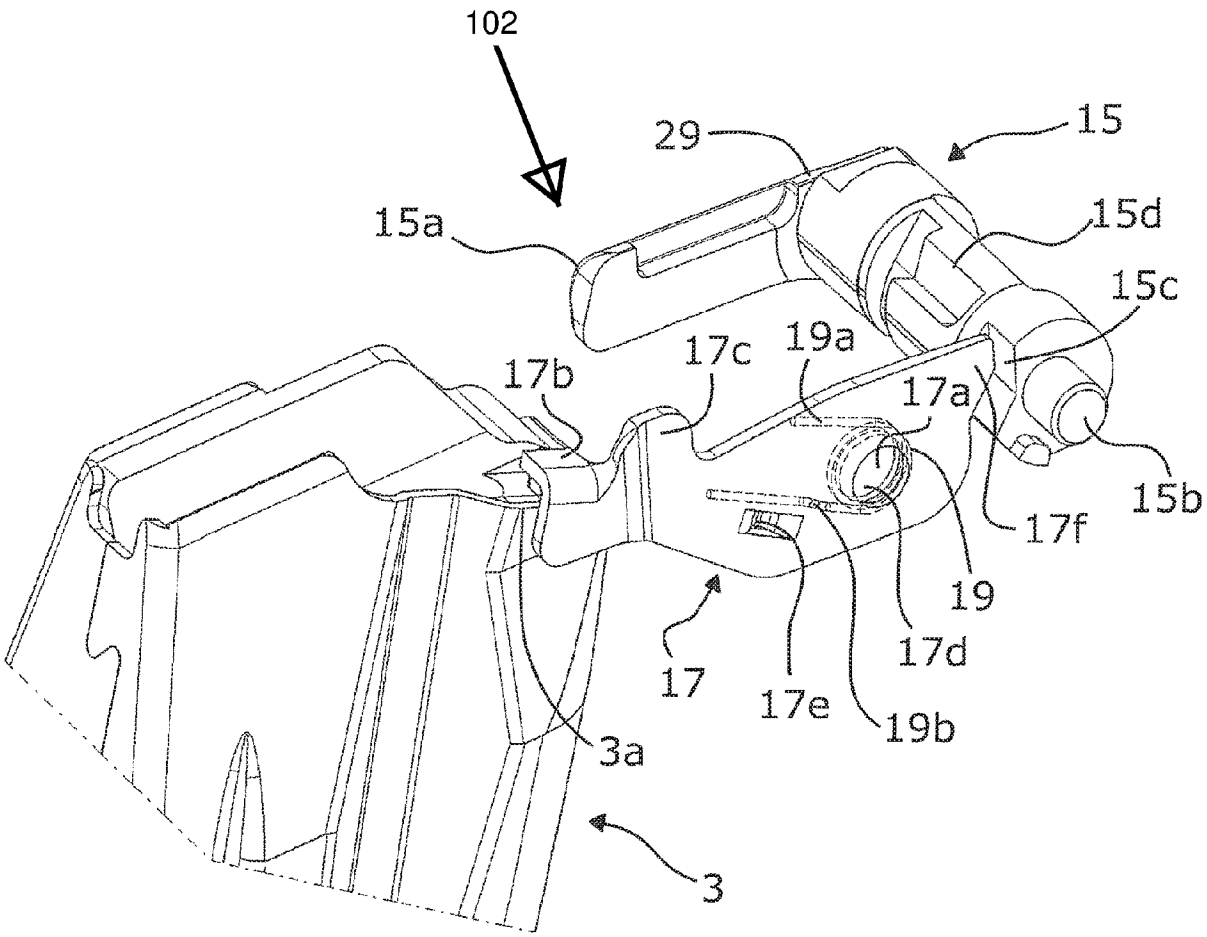
FIG. 5 illustrates a detailed isometric view of the example disassembly device and a magazine disposed within a magazine well of the pistol, an example shaft of the disassembly device being shown in a locked position and an example disassembly arm of the example disassembly device being shown in a blocking position.

The example of FIG. 2 illustrates the pistol 1 with the breech slide 7 being retained in the rearward position by an example breech catch lever and/or an example slide catch lever 10. In some examples, when the breech slide 7 is moved to the rearward position, any cartridge disposed within a cartridge chamber of the barrel 9 and/or the pistol 1 is ejected from the pistol 1. As shown in FIG. 2, the breech slide 7 is in the retracted and/or rearward position and the shaft 15 and the handle 15*a* are in the locked and/or blocking position. As shown in the example of FIG. 5, when the shaft 15 is in the locked position, the shaft 15 and/or a recess, a projection, a locking projection and/or a retaining edge 15*d* of the shaft 15 engages and/or blocks the forward movement of a projection 12 (FIG. 4) on an underside of the barrel 9. Thus, when the shaft 15 is in the locked position, in some examples, the interaction between the shaft 15 and the projection 12 on the barrel 9 prevents and/or deters the breech slide 7 and the barrel 9 from being separated from the frame 104 and/or the grip 2. In some examples, when the shaft 15 is rotated to the unlocked and/or release position, the shaft 15 does not engage and/or block the forward movement of the projection 12 of the barrel 9. Thus, when the shaft 15 is in the unlocked position, in some examples, the shaft 15 enables the projection 12 to be moved forward and for the slide 7 and the barrel 9 to be separated from the frame 104 and/or the grip 2.

As illustrated in the example of FIG. 3, in some examples, when the magazine is not disposed within the pistol 1 and the breech slide 7 is in the retracted position, the handle 15*a* and/or shaft 15 are rotatable clockwise to position the disassembly device 102 in the unlocked, disassembly and/or the release position. In some examples, in the unlocked position, the handle 15*a* is pointed generally downward. As illustrated in the example of FIG. 4, after the breech catch lever 10 is released to enable forward movement of the breech slide 7, the breech slide 7, the barrel 9 and an example recoil spring assembly 31 (FIG. 4) can be removed from the frame 104 and the grip 2.

FIG. 5 illustrates an example interior of the grip 2 on a left side of the pistol 1 showing the magazine 3 having an example magazine wall 3*a*. As shown in FIG. 5, the example disassembly arm and/or the disassembly protection element 17 is rotatably and/or pivotably coupled to the pistol 1 about an axis 17*a*. In some examples, when the magazine 3 is disposed within the grip 2 and/or the magazine well, the wall 3*a* of the magazine 3 engages a lug and/or end 17*b* of the disassembly arm 17. In some examples, the interaction between the lug 17*b* and the magazine 3 urges the lug 17*b* upward and urges an opposing end, front end and/or stop 17*f* of the disassembly arm 17 downward and into engagement with a recess, indent and/or locking surface 15*c* of the shaft 15 to prevent and/or deter rotation of the shaft 15 from the locked position to the unlocked and/or release position. In the illustrated example, the disassembly arm 17 including the lug 17*b* is produced of a single-piece of metal and/or sheet metal. However, the disassembly arm 17 may be produced in any suitable way and/or may include multiple components.

In the illustrated example, a lower leg 19*b* of the spring 19 engages on a projection 17*e* of the disassembly arm 17 and an upper leg 19*a* of the spring 19 engages on a surface of the grip 2 and/or the pistol 1 to enable the spring 19 to bias the disassembly arm 17 in a counterclockwise direction. In some examples, the spring 19 is pre-stressed. In the illustrated example, the spring 19 is disposed about a circular recess and/or an aperture 17*d* at approximately a middle and/or a center of the disassembly arm 17. In the locking position of the disassembly arm 17 and as shown in FIG. 5, the front end 17*f* of the disassembly arm 17 engages against and/or is positioned immediately adjacent one or more surfaces of the recess 15*c*. In some examples, a contour and/or a profile of the front end 17*f* corresponds to a contour and/or a profile of the recess 15*c*. In some examples, the shaft 15 is rotatably mounted on a pin and/or a pivot pin 15*b* coupled to and/or disposed in the grip 2 and/or pistol 1.

When the magazine 3 is disposed within the grip 2, the examples disclosed herein enable the magazine 3 to rotate the disassembly arm 17 into a locking position that disposes the front end 17*f* of the disassembly arm 17 within the recess 15*c* of the shaft 15 and prevents and/or deters the shaft 15 from being moved, via the handle 15*a*, from the locked and/or assembled position. In some examples, when the disassembly device 100, the shaft 15 and/or the disassembly arm 17 are in the locking position, the interaction between the projection 12 on the barrel 9 and the locking projection of the shaft 15 prevent and/or deter the breech slide 7 and the barrel 9 from being separated from the grip 2 and/or the frame 104.

Figure 6:
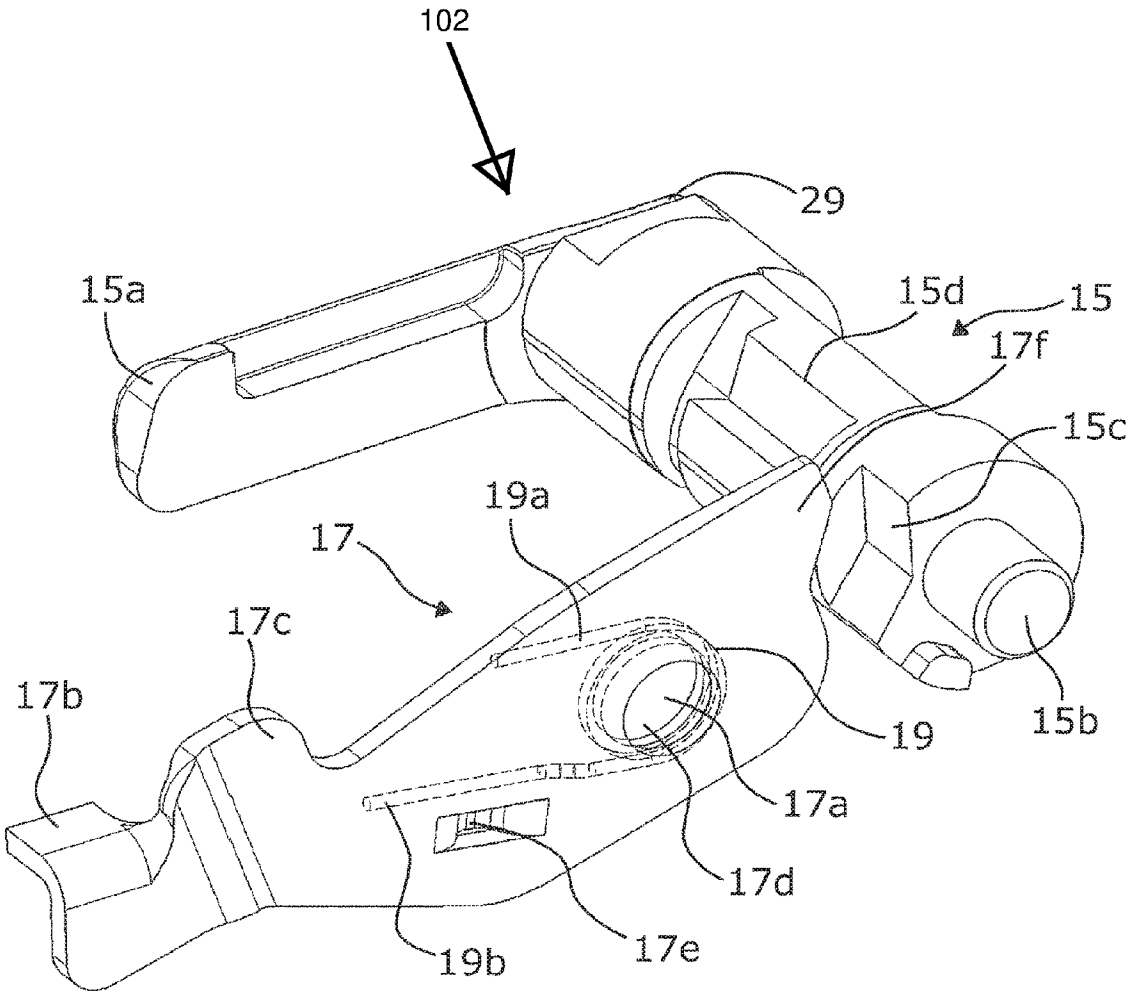
FIG. 6 illustrates a detailed isometric view of the example disassembly device with the magazine removed from the magazine well, the example shaft of the disassembly device being shown in a locked position and the example projection of the example disassembly device being shown in a release position.

The example of FIG. 6 illustrates the disassembly device 102 including the shaft 15 and the disassembly arm 17 with the magazine 3 removed from the magazine well and/or the pistol 1. As shown in FIG. 6, without the magazine 3 urging the disassembly arm 17 clockwise against the spring force of the spring 19, the spring 19 urges the disassembly arm 17 counterclockwise, the lug 17*b* downward and the front end 17*f* of the shaft 15 upward and away from the recess 15*c*. In some examples, when the front end 17*f* is spaced from the recess 15*c*, the disassembly arm 17 no longer ensures that the shaft 15 is retained in the locked position and the shaft 15 is rotatable from the locked position to the unlocked and/or released position.

Figure 7:
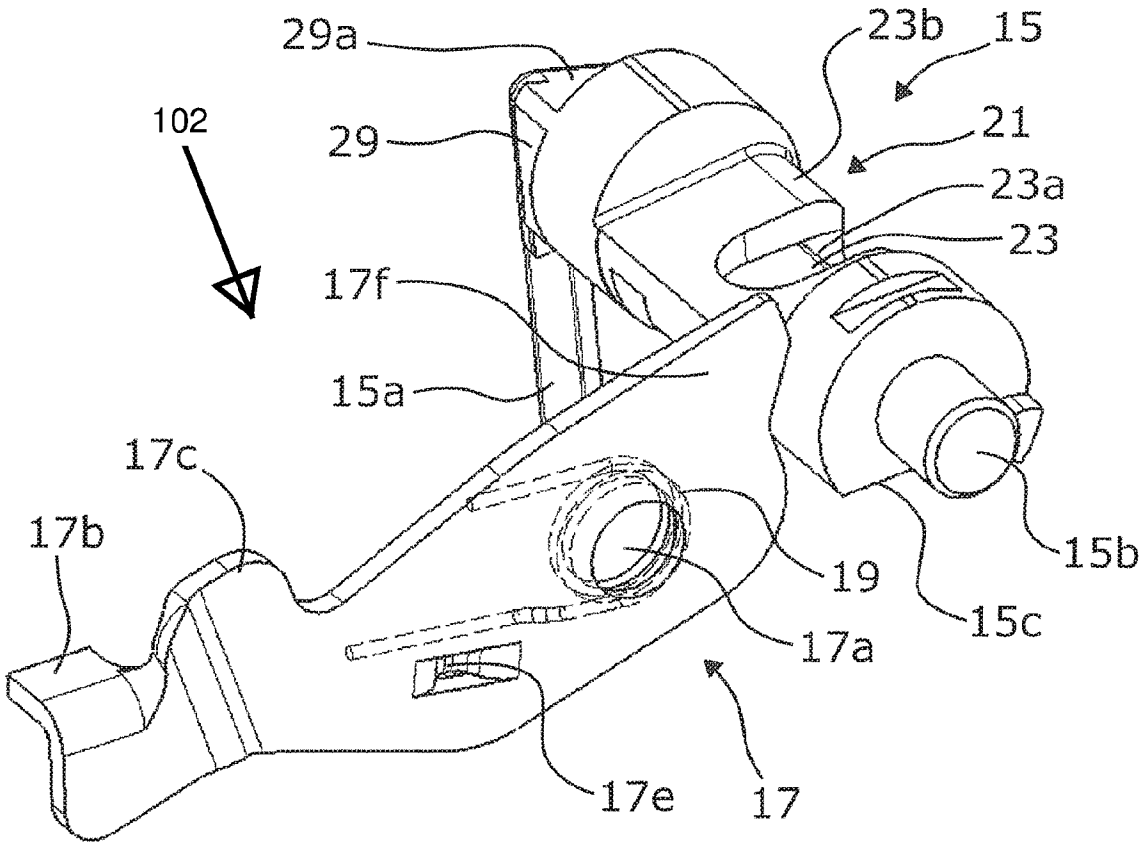
FIG. 7 illustrates a detailed isometric view of the example disassembly device with the magazine removed from the magazine well, the example shaft of the disassembly device being shown in an unlocked position and an example disassembly arm of the example disassembly device being shown in a release position.

When the magazine 3 is removed from the magazine well of the pistol 1, the breech slide 7 is in the retracted position and the front end 17*f* of the disassembly arm 17 is spaced from the recess 15*c*, the handle 15*a* can be rotated (e.g., approximately a 90° rotation) from the locked position of the shaft 15 to the unlocked and/or released position of the shaft 15. In some examples and as shown in FIG. 7, rotating the shaft 15 downward approximately 90° rotates the retaining edge and/or locking projection 15*d* of the shaft 15 downward and rotates a recess and/or channel 21 of the shaft 15 upward to enable the breech slide 7, the barrel 9 and the recoil spring assembly 31 to be moved forward to separate the breech slide 7, the barrel 9 and the recoil spring assembly 31 from the grip 2 and/or the frame 104. In other words, when the shaft 15 is rotated from the locked position to the unlocked and/or release position, the locking projection 15*d* is rotated out of the path of the barrel 9 to enable the barrel 9, the breech slide 7 and the recoil spring assembly 31 to be moved past the shaft 15 to separate the breech slide 7, the barrel 9 and the recoil spring assembly 31 from the grip 2 and/or the frame 104. In some examples, when the shaft 15 is in the unlocked and/or release position and the breech slide 7 is being moved forward to separate the breech slide 7 from the grip 2 and/or the frame 104, the breech slide 7 moves past and/or slides past a surface 29*a* of the handle 15*a* and/or the shaft 15.

As shown in the example of FIG. 7, the shaft 15 includes a bearing surface, groove and/or recess 23 that is to support a rear portion and/or an end of the recoil spring assembly 31. In some examples, the bearing surface 23 receives a pin 32 (FIG. 4) of the recoil spring assembly 31. In some examples, because of the interaction of the recoil spring assembly 31 and the bearing surface 23, when the shaft 15 is rotated, the recoil spring assembly 31 skips and/or extends past edges 23*a*, 23*b* of the shaft 15 to secure the shaft 15 in the unlocked and/or release position.

In some examples, if the shaft 15 is rotated into the unlocked and/or release position and the magazine 3 is attempted to be inserted into the magazine well, the magazine 3 engages the lug 17*b* of the disassembly arm 17 and rotates the disassembly arm 17 until the front end 17*f* engages an exterior and/or arced surface of the shaft 15. The interaction between the front end 17*f* and the arced surface of the shaft 15 prevents the disassembly arm 17 from being fully rotated to the locked position and prevents the magazine 3 from being fully received within the magazine well. In other words, rotating the shaft 15 to the unlocked and/or release position rotates the recess 15*c* to a position that prevents the front end 17*f* of the disassembly arm 17 from being positioned within the recess 15*c* to enable the magazine 3 to be fully received within the magazine well. In some examples, the magazine 3 is fully insertable into the magazine well when the shaft 15 is in the locked position and the breech slide 7 is retained in the rearward position by the breech catch lever 10.

Figure 8:
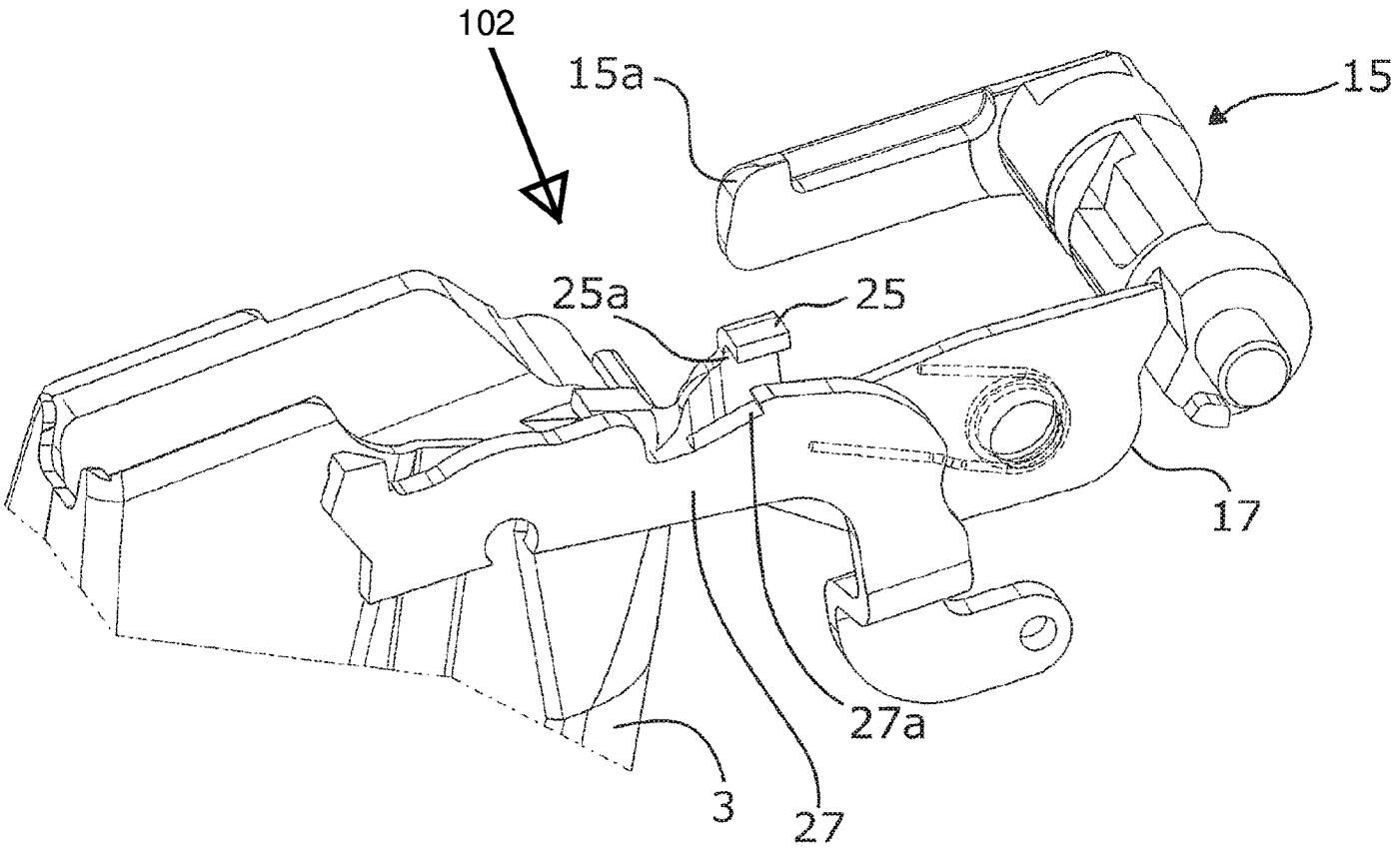
FIG. 8 illustrates a detailed isometric view of the example disassembly device and a magazine disposed within a magazine well of the pistol, an example shaft of the disassembly device being shown in a locked position and an example disassembly arm is in a trigger bar release position.
Figure 9:
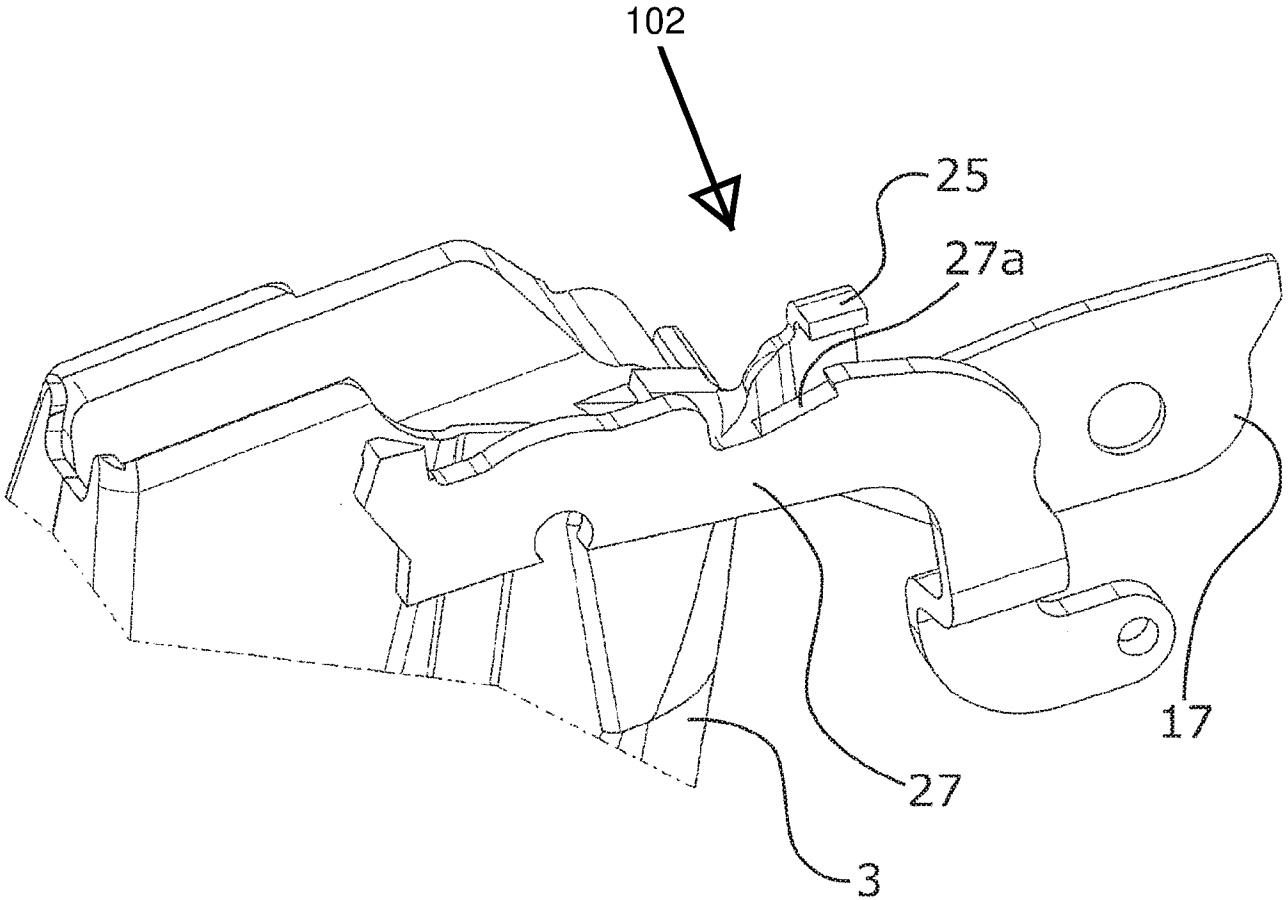
FIG. 9 is a detailed view of FIG. 8 with the example shaft of the disassembly device not being shown.
Figure 10:
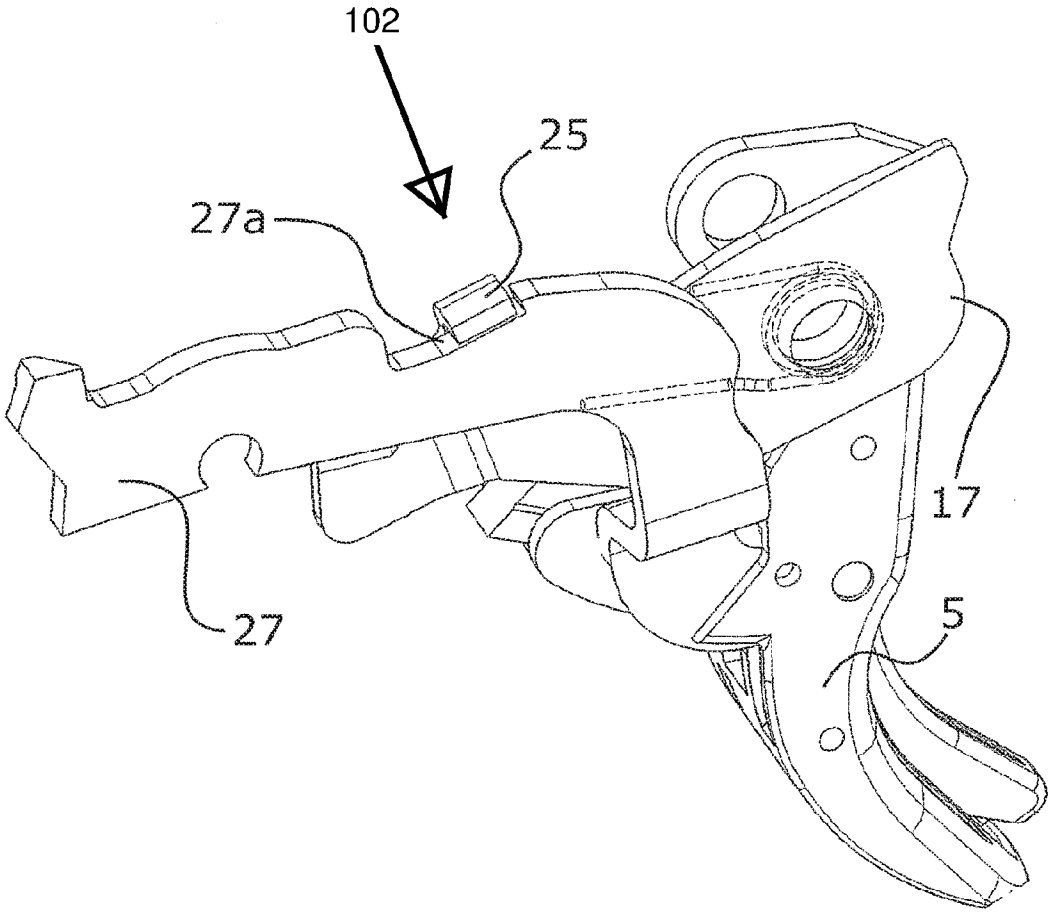
FIG. 10 illustrates a detailed view of the example disassembly device in a release position and an example safety of the pistol in a blocking position.

In the illustrated examples of FIGS. 8-10, the trigger 5 is secured when the magazine 3 is removed from the magazine well and/or the pistol 1. In the example of FIG. 8, instead of the example disassembly arm 17 including a curved portion and/or formation 17*c* (see FIG. 6), the disassembly arm 17 of FIG. 8 includes an example web and/or projection 25*a* including a bend, lip and/or lug 25. In some examples and as shown in FIGS. 8 and 9, when the magazine 3 is disposed within the pistol 1 and the disassembly arm 17 is rotated clockwise based on the engagement with the magazine 3, the lug 25 is spaced from an example trigger bar 27 enabling the trigger 5 to be actuated. As shown in the example of FIG. 10, when the magazine 3 has not moved the disassembly arm 17 and/or the magazine 3 is not fully positioned within the pistol 1, the spring 19 rotates the disassembly arm 17 and the lug 25 counterclockwise to enable the lug 25 to engage and/or interact with a surface and/or recess 27*a* of the trigger bar 27 to prevent and/or deter the trigger 5 from being actuated.

The examples disclosed herein enable handguns and/or pistols to be disassembled when the magazine is removed from the firearm and prevents and/or deters a round from being chambered after the shaft of the disassembly device is moved to the unlocked and/or release position.

In some examples, the example shaft of the disassembly device is usable independently of the example disassembly arm.

In some examples, the disassembly arm and/or the disassembly prevention element is pivotably mounted within the firearm about a pivot axis and is movable between a blocking or locked position and a release or unlocked position. In some examples, the blocking position is associated with a magazine being received within a magazine well of the firearm. In some examples, the release position is associated with a magazine not being fully disposed within the firearm and/or not being disposed within the firearm.

The examples disclosed herein relate to firearms including example disassembly devices and/or disassembly prevention devices.

The examples disclosed herein include an example mechanical disassembly lock that prevents and/or deters the firearm from being disassembled unless the magazine is removed from the firearm. The examples disclosed herein encourage firearms to be disassembled in a safe manner by preventing and/or deterring a cartridge from being chambered when the firearm is being disassembled or assembled.

In some examples, to separate the breech slide and the barrel from the frame and/or the grip of the firearm and/or to disassemble the firearm, the magazine is removed, the breech slide is moved rearward and retained, the shaft of the disassembly device is rotated to the unlocked and/or release position, the breech slide is released by actuating the breech catch lever and the breech slide, the barrel and the recoil spring assembly are guided forward relative to an axis of the firearm. In some examples, to couple the breech slide, the barrel and the frame and/or the grip of the firearm and/or to assemble the firearm, the breech slide, the barrel and the recoil spring assembly are guided rearward relative to an axis of the firearm, the breech slide is moved rearward and retained by the breech catch lever, the shaft of the disassembly device is rotated to the locked position, the breech slide is released by actuating the breech catch lever and the magazine is positioned within the magazine well. However, in some examples, the firearm may be assembled and/or disassembled in a different order and/or in a different manner.

The example disassemble devices including the example rotational shaft are less susceptible to contamination by sand, dirt, particulate, etc. and have less bearing and/or wearing surfaces as compared to longitudinally mounted components. In some examples, the disassemble prevention arm is configured and/or sized to provide a relatively high degree of leverage on, for example, the shaft of the disassembly device.

In some examples, a spring and/or a biasing element biases the disassembly arm toward a release and/or a unlocked position where the front end of the disassembly arm is spaced from the locking recess of the shaft. In some examples, an end of the magazine engages and/or pivots the disassembly arm to the locking position. In some examples, when the end of the magazine is not engaging the disassembly arm, the spring and/or biasing element moves the disassembly arm to the release and/or unlocked position. The spring and/or biasing element may be rubber, plastic, an elastomer, metal, a torsion spring, a spring, etc.

In some examples, in the locking position of the shaft and the locking position of the disassembly arm, the disassembly arm includes an end that engages and/or interacts with a surface and/or a recess of the shaft to prevent and/or deter the firearm from being disassembled and/or to prevent and/or deter the shaft of the disassembly device from being moved from the locked position to the release or unlocked position. In other words, the interaction between the disassembly arm and the shaft prevent and/or deter the shaft from being rotated and/or prevent and/or deter a magazine from being fully received within the pistol.

In some examples, when the magazine is removed from the firearm, the spring moves the disassembly arm to the unlocked or release position and/or rotates the disassembly arm counterclockwise, for example.

In some examples, the disassembly arm includes an end having a lug that interacts with and/or is engagable by the magazine to actuate the disassembly arm from the unlocked or release position to the locked and/or the blocking position. In some examples, the magazine moves the disassembly arm by overcoming a spring force of the spring acting on the disassembly arm. In some examples, the interaction between the magazine and the lug in turn causes the front end of the disassembly arm to be received within the recess of the shaft to prevent and/or deter the shaft from being moved from the locked position.

In some examples, in the locking position of the disassembly device, a projection and/or surface of the shaft interacts with a projection and/or surface of the barrel to prevent and/or deter the barrel, the breech sleeve and/or the recoil spring assembly from being separated from the frame and/or the grip of the pistol. In some examples, the interaction and/or engagement between corresponding surfaces of the shaft of the disassembly device and the barrel prevent and/or deter the barrel, the breech sleeve and/or the recoil spring assembly from being separated from the frame and/or the grip of the pistol.

In some examples, when the disassembly arm is in an unlocked and/or a release position, the shaft of the disassembly device can be rotated to the unlocked position to enable the barrel, the breech sleeve and/or the recoil spring assembly to be separated from the frame and/or the grip of the pistol.

In some examples, the disassembly arm includes a lug and/or trigger safety element, which is movable between a trigger secured position and a trigger actuatable position. In some examples, when the magazine is disposed within the firearm, the magazine moves the disassembly arm to space the lug from the trigger bar enabling the trigger bar to be in the trigger actuatable position. In some examples, when the magazine is not disposed within the firearm and the disassembly arm rotates counterclockwise under the influence of the spring, the lug engages the trigger bar and/or a recess of the trigger bar and the trigger is in the trigger secured position. In some examples, the engagement between the disassembly arm and the trigger bar fixes and/or secures the trigger bar enabling the trigger to be retained in the trigger secured position. In some such examples, when the magazine is removed from the firearm, the trigger is secured to prevent and/or deter the trigger from being actuated. In some examples, when the magazine is fully inserted into the firearm, the magazine engages the disassembly arm moving the lug away from the trigger bar to enable the trigger to be positioned in the trigger actuatable position. In some examples, the trigger bar is biased via a spring to the trigger actuatable position and/or another position.

In some examples, the example shaft of the disassembly device and the example disassembly arm of the disassembly device may be separately provided for and/or within a firearm. In some examples, a firearm may be provided with the disassembly actuation arm where the disassembly actuation arm does not interact with the shaft of the disassembly device. In some examples, a firearm is provided with the disassembly actuation arm with and/or without the lug to interact with a trigger bar.

In some examples, firearms may be retrofitted with the examples disclosed herein. In some examples, the examples disclosed herein may be constructed and/or manufactured in a cost effective manner.

In some examples, firearms may be retrofitted with the examples disclosed herein by replacing one or more components of the firearm such as, for example, the grip of the firearm.

In some examples, the breech slide includes a recess and/or an aperture that configured to complement and/or enable the rotation of the shaft of the disassembly device when the breech slide is in the rearward position. In some examples, a cross-section of the shaft and/or a cross-section of the handle of the disassembly device prevents and/or deters the shaft from being rotated unless the recess of the breech slide is immediately adjacent the shaft and/or the handle. In some examples, when the handle of the disassembly device is in the locked position, in some examples, a relatively flat surface of the handle faces upward and a semi-circular surface of the handle is disposed below the relatively flat surface. Thus, in some examples, unless the recess of the breech is immediately adjacent the handle, the interaction between the shaft and/or the handle and the otherwise flat surface of the breech (e.g., the underside and/or downward facing surfaces of the breech 7 are flat and/or relatively flat besides the recess) prevents and/or deters the semi-circular surface of the handle from facing upward. In some examples, positioning the relatively flat surface of the handle upward when the disassembly device is in the locked position enables the breech slide to move back and forth as the firearm cycles.

In some examples, an example disassembly protection device of a self-loading pistol 1 includes a dismantling shaft 15 arranged inside a grip 2, which is rotatable by an external handle 15*a* between a locked position to lock the barrel 9 and a disassembly position to disassemble the barrel 9; a disassembly protection element 17 is movable between a locked position and a released position, which in the locked position engages with a first end of the dismantling shaft 15 and fixes the dismantling shaft 15 in the locked position and which in the released position is disengaged with its first end from the dismantling shaft 15 and releases the dismantling shaft 15 for rotation in the disassembly position, which at the second end of the disassembly protection element 17 is impinged by a magazine 3 inserted into the self-loading pistol and thus is brought into its locked position and can be brought to its release position with a fully or partially removed magazine 3, characterized in that the disassembly protection element 17 is pivotably mounted about an axis 17*a* of rotation to take up its locked position or release position.

In some examples, an elastic component for exertion of a preload on the disassembly protection element 17 in the direction of its release position. In some examples, the elastic component is designed as a spring element, in particular, as a recoil spring 19. In some examples, at least one end stop 17*f* is formed at the first end of the disassembly protection elements 17 and, in the locked position, abuts on a locking surface 15*c* of the dismantling shaft 15. In some examples, when the magazine 3 is removed, the first end of the disassembly protection elements 17 can be brought to its release position disengaged from the locking surface 15*c* as a consequence of a pivoting movement following the force of the elastic component. In some examples, the disassembly protection element 17 includes at the second end a lug 17*b*, which is designed for an engagement with the magazine 3, in particular a wall 3*a* and thus the inserted magazine 3 moves the disassembly protection element 17 into the locked position against the force of the elastic component. In some examples, when the magazine 3 is inserted, the disassembly protection element 17 is in a frictional and positive connection with the magazine wall 3*a* and the dismantling shaft 15. In some examples, the dismantling shaft 15 is formed as a locking protrusion, which fixes the barrel 9 in the locked position of the dismantling shaft 15, in particular with a retaining edge 15*d* formed at the rear edge of the locking protrusion.

In some examples, in the release position of the disassembly protection element 17, the dismantling shaft 15 can be moved by the handle 15*a* into its disassembly position, in which it releases the barrel 9 through a recess 21 formed in the dismantling shaft 15 together with the breech slide 7 and the recoil spring assembly 31 to be removed in the forward direction. In some examples, a trigger bar safety element, which can be moved between a trigger bar locked position and a trigger bar release position, and in the trigger bar locked position fixes a trigger bar 27 by means of an operative engagement and in the trigger bar release position releases the trigger bar 27.

In some examples, the trigger safety element is formed as the lug 25 in the rear region of the disassembly protection element 17, which is designed for engagement with a recess 27*a* in the trigger bar 27. In some examples, when the magazine 3 is removed from the self-loading pistol, upon a pivoting of the disassembly protection element 17 under the force effect of the elastic component 19, the lug 25 engages with the complementary recess 27*a* and fixes the trigger bar 27. In some examples, when the magazine 3 is inserted, the lug 25 disengages from the recess 27*a* by an upward movement of the second end of the disassembly protection elements 17 against the force of the elastic component 19. In some examples, a firearm includes the disassembly protection device as disclosed herein.

In some examples, a breech slide includes at least one recess 8 formed complementarily to the outer circumference of the dismantling shaft 15, such that the dismantling shaft 15 is rotatable in the recess 8. In some examples, a trigger bar 27 with a recess 27*a* is complementary to a lug 25 of the trigger safety element.

The examples disclosed herein relate to a disassembly protection device of a self-loading pistol 1, with: a dismantling shaft 15 arranged inside the grip 2, which can be rotated by means of an outer handle 15*a* between a locking position to lock the barrel 9 and a disassembly position to disassemble the barrel; a disassembly protection element 17 that can be moved between a locked position and a release position, which in its locked position engages with a first end with the dismantling shaft 15 and thus fixes it in its locked position and which in its release position is disengaged with a first end from the dismantling shaft 15 and releases it for rotation in its disassembly position and which at its second end is impinged by a magazine 3 inserted into the self-loading pistol and thus is moved to its locked position and, with the magazine 3 fully or partially removed, can be moved to its release position, characterized in that the disassembly protection element 17 is pivotably mounted about an axis 17*a* of rotation to take up its locked position or release position.

An example apparatus for use with a firearm, includes a shaft to be disposed within the firearm, the shaft being rotatable via a handle between a first locked position and an first unlocked position, in the first locked position, the shaft to secure the barrel relative to the firearm, in the first unlocked position, the shaft to enable the barrel to be separated from the firearm; a disassembly arm to be pivotable about an axis between a second locked position and a second unlocked position, when the shaft is in the first locked position and the disassembly arm is in the second locked position, a first end of the disassembly arm to interact with the shaft to secure the shaft in the first locked position, when the shaft is in the first locked position and the disassembly arm is in the second unlocked position, the first end of the disassembly arm to be spaced from the shaft to enable the shaft to be rotated from the first locked position, the disassembly arm being movable to the second locked position from the second unlocked position based on a magazine engaging a second end of the disassembly arm, the disassembly arm being movable to the second unlocked position from the second locked position based on the magazine being spaced from the second end of the disassembly arm or the magazine not being fully received within the firearm.

In some examples, the disassembly arm is biased toward the second unlocked position. In some examples, the apparatus includes a spring to bias the disassembly arm toward the second unlocked position. In some examples, when the shaft is in the first locked position and the disassembly arm is in the second locked position, the first end of the disassembly arm is to be disposed in a recess of the shaft to secure the shaft in the first locked position. In some examples, the apparatus includes a biasing element to pivot the disassembly arm to the second unlocked position when the magazine is spaced from the second end of the disassembly or the magazine is not fully received within the firearm. In some examples, the disassembly arm includes a lug to be engaged by the magazine to move the disassembly arm from the second unlocked position when the magazine engages the second end of the disassembly arm or when the magazine is fully received within the firearm. In some examples, when the magazine engages the second end of the disassembly arm or when the magazine is fully received within the firearm, the disassembly arm is in the second locked position to engage the shaft.

In some examples, the shaft includes a protrusion, in the first locked position, the protrusion to interact with the barrel to secure the barrel relative to the firearm. In some examples, when the disassembly arm is in the second unlocked position and the shaft is in the first unlocked position, the shaft to enable the barrel, a breech slide, and a recoil spring assembly to be separated from the firearm. In some examples, the shaft includes a recess to enable the barrel, a breech slide, and a recoil spring assembly to be separated from the firearm when the shaft is in the first unlocked position. In some examples, the disassembly arm includes a lug movable between a third locked position and a third unlocked position, in the third locked position, the lug to interact with a trigger bar to secure the trigger bar, in the third unlocked position, the lug to be spaced from the trigger bar to enable the trigger bar to move. In some examples, the lug is movable to the third unlocked position is based on the magazine engaging the second end of the disassembly arm, the lug being movable to the third locked position based on the magazine being spaced from the second end of the disassembly arm or the magazine not being fully received within the firearm. In some examples, the trigger bar includes a recess to receive the lug when the lug is in the third locked position.

An example firearm, includes a frame; a breech slide to be coupled to the frame, the breech slide including an aperture to face the frame, the breech slide being movable between a forward position and a rearward position; a barrel to be disposed within the breech slide; and a shaft to extend through the frame, when the breech slide is in the rearward position, the aperture being positioned to receive a portion of the shaft to enable the shaft to be rotated and to enable the barrel to be separated from the firearm. In some examples, the shaft is rotatable via a handle between a first locked position and a first unlocked position, in the first locked position, the shaft to secure the barrel relative to the frame. In some examples, a disassembly arm to be pivotable about an axis between a second locked position and a second unlocked position, when the shaft is in the first locked position and the disassembly arm is in the second locked position, a first end of the disassembly arm to interact with the shaft to secure the shaft in the first locked position. In some examples, when the shaft is in the first locked position and the disassembly arm is in the second unlocked position, the first end of the disassembly arm to be spaced from the shaft to enable the shaft to be rotated from the first locked position. In some examples, the disassembly arm being movable to the second locked position is based on a magazine engaging a second end of the disassembly arm, the disassembly arm being movable to the second unlocked position based on the magazine being spaced from the second end of the disassembly arm or the magazine not being fully received within the firearm.

An example firearm includes a frame; a breech slide to be coupled to the frame, the breech slide being movable between a forward position and a rearward position; a barrel to be disposed within the breech slide; a trigger bar disposed within the frame; and an arm to be pivotable about an axis between a locked position and a unlocked position, the arm being movable to the unlocked position from the locked position based on a magazine engaging an end of the arm, the arm being movable to the locked position from the unlocked position based on the magazine being spaced from the end of the arm or the magazine not being fully received within the firearm, in the locked position, the arm to interact with the trigger bar to secure the trigger bar, in the unlocked position, the lug to be spaced from the trigger bar to enable the trigger bar to move.

In some examples, the locked position is a first locked position and the unlocked position in a first unlocked position, further including a shaft to extend through the frame, the shaft being rotatable via a handle between a second locked position and a second unlocked position, in the second locked position, the shaft to secure the barrel relative to the frame. In some examples, the firearm includes a disassembly arm to be pivotable about an axis between a third locked position and a third unlocked position, when the shaft is in the second locked position and the disassembly arm is in the third locked position, an end of the disassembly arm to interact with the shaft to secure the shaft in the second locked position.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus for use with a firearm, comprising:

a shaft to be disposed within the firearm, the shaft being rotatable via a handle between a first locked position and a first unlocked position, in the first locked position, the shaft to secure the barrel relative to the firearm, in the first unlocked position, the shaft to enable the barrel to be separated from the firearm;

a disassembly arm to be pivotable about an axis between a second locked position and a second unlocked position, when the shaft is in the first locked position and the disassembly arm is in the second locked position, a first end of the disassembly arm to interact with the shaft to secure the shaft in the first locked position, when the shaft is in the first locked position and the disassembly arm is in the second unlocked position, the first end of the disassembly arm to be spaced from the shaft to enable the shaft to be rotated from the first locked position, the disassembly arm being movable to the second locked position from the second unlocked position based on a magazine engaging a second end of the disassembly arm, the disassembly arm being movable to the second unlocked position from the second locked position based on the magazine being spaced from the second end of the disassembly arm or the magazine not being fully received within the firearm.

2. The apparatus of claim 1, wherein the disassembly arm is biased toward the second unlocked position.

3. The apparatus of claim 2, further including a spring to bias the disassembly arm toward the second unlocked position.

4. The apparatus of claim 1, wherein when the shaft is in the first locked position and the disassembly arm is in the second locked position, the first end of the disassembly arm is to be disposed in a recess of the shaft to secure the shaft in the first locked position.

5. The apparatus of claim 1, further including a biasing element to pivot the disassembly arm to the second unlocked position when the magazine is spaced from the second end of the disassembly or the magazine is not fully received within the firearm.

6. The apparatus of claim 1, wherein the disassembly arm includes a lug to be engaged by the magazine to move the disassembly arm from the second unlocked position when the magazine engages the second end of the disassembly arm or when the magazine is fully received within the firearm.

7. The apparatus of claim 1, wherein when the magazine engages the second end of the disassembly arm or when the magazine is fully received within the firearm, the disassembly arm is in the second locked position to engage the shaft.

8. The apparatus of claim 1, wherein the shaft includes a protrusion, in the first locked position, the protrusion to interact with the barrel to secure the barrel relative to the firearm.

9. The apparatus of claim 1, wherein when the disassembly arm is in the second unlocked position and the shaft is in the first unlocked position, the shaft to enable the barrel, a breech slide, and a recoil spring assembly to be separated from the firearm.

10. The apparatus of claim 1, wherein the shaft includes a recess to enable the barrel, a breech slide, and a recoil spring assembly to be separated from the firearm when the shaft is in the first unlocked position.

11. The apparatus of claim 1, wherein the disassembly arm includes a lug movable between a third locked position and a third unlocked position, in the third locked position, the lug to interact with a trigger bar to secure the trigger bar, in the third unlocked position, the lug to be spaced from the trigger bar to enable the trigger bar to move.

12. The apparatus of claim 11, wherein the lug being movable to the third unlocked position is based on the magazine engaging the second end of the disassembly arm, the lug being movable to the third locked position based on the magazine being spaced from the second end of the disassembly arm or the magazine not being fully received within the firearm.

13. The apparatus of claim 11, wherein the trigger bar includes a recess to receive the lug when the lug is in the third locked position.

14. An apparatus, comprising:

a frame;

a shaft to be disposed within the frame, the shaft being rotatable via a handle between a first locked position and a first unlocked position, in the first locked position, the shaft to secure a barrel relative to the frame, in the first unlocked position, the shaft to enable the barrel to be separated from the frame;

a disassembly arm to be pivotable about an axis between a second locked position and a second unlocked position, when the shaft is in the first locked position and the disassembly arm is in the second locked position, a first end of the disassembly arm to interact with the shaft to secure the shaft in the first locked position, when the shaft is in the first locked position and the disassembly arm is in the second unlocked position, the first end of the disassembly arm to be spaced from the shaft to enable the shaft to be rotated from the first locked position, the disassembly arm being movable to the second locked position from the second unlocked position based on a magazine engaging a second end of the disassembly arm, the disassembly arm being movable to the second unlocked position from the second locked position based on the magazine being spaced from the second end of the disassembly arm or the magazine not being fully received within the frame.

15. The apparatus of claim 14, wherein the frame is a firearm frame.

16. A firearm, comprising:

a frame;

a breech slide to be coupled to the frame, the breech slide being movable between a forward position and a rearward position;

a barrel to be disposed within the breech slide;

a shaft to be disposed within the frame, the shaft being rotatable via a handle between a first locked position and a first unlocked position, in the first locked position, the shaft to secure the barrel relative to the frame, in the first unlocked position, the shaft to enable the barrel to be separated from the frame;

a disassembly arm to be pivotable about an axis between a second locked position and a second unlocked position, when the shaft is in the first locked position and the disassembly arm is in the second locked position, a first end of the disassembly arm to interact with the shaft to secure the shaft in the first locked position, when the shaft is in the first locked position and the disassembly arm is in the second unlocked position, the first end of the disassembly arm to be spaced from the shaft to enable the shaft to be rotated from the first locked position, the disassembly arm being movable to the second locked position from the second unlocked position based on a magazine engaging a second end of the disassembly arm, the disassembly arm being movable to the second unlocked position from the second locked position based on the magazine being spaced from the second end of the disassembly arm or the magazine not being fully received within the frame.

* * * * *